United States Patent [19]

Ponte

[11] Patent Number: 4,474,123

[45] Date of Patent: Oct. 2, 1984

[54] WORK CLAMP SHIFTING MECHANISM FOR SEWING MACHINES

[75] Inventor: Gary W. Ponte, Passaic, N.J.

[73] Assignee: The Singer Company, Stamford, Conn.

[21] Appl. No.: 488,904

[22] Filed: Apr. 27, 1983

[51] Int. Cl.[3] ..... D05B 3/14; D05B 97/10; D05B 47/02

[52] U.S. Cl. ..... 112/112; 112/157; 112/169; 112/254

[58] Field of Search ..... 112/70, 110, 112, 169, 112/254, 265.1, 157

[56] References Cited

U.S. PATENT DOCUMENTS

Re. 21,016 2/1939 Lyons ..... 112/112

436,321 9/1890 Stirckler ..... 112/112

649,871 5/1900 Merritt ..... 112/112

3,098,459 7/1963 Bono ..... 112/157 X

FOREIGN PATENT DOCUMENTS 1126712 3/1962 Fed. Rep. of Germany ..... 112/157

*Primary Examiner*—Wm. Carter Reynolds

*Attorney, Agent, or Firm*—Robert E. Smith; Edward L. Bell

[57] ABSTRACT

A work clamp shifting mechanism for a four hole button sewing machine in which operator influenced cam shifts the work holding jaws between two detent retained positions and also releases the thread tension during each shift between detent positions to defer the work from being disoriented in the work holding jaws.

4 Claims, 8 Drawing Figures

Fig. 5
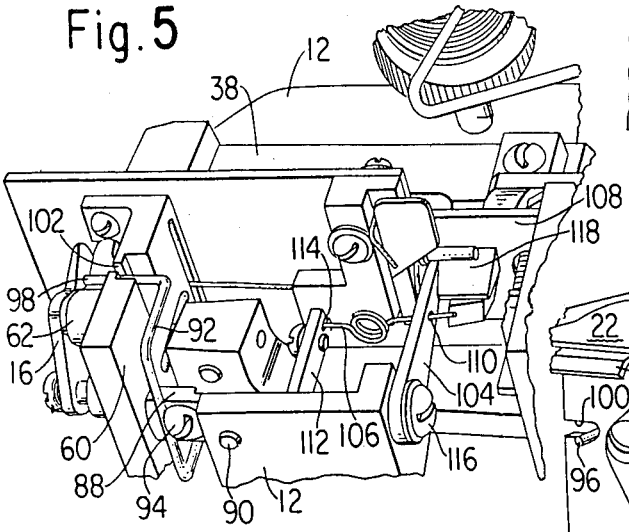
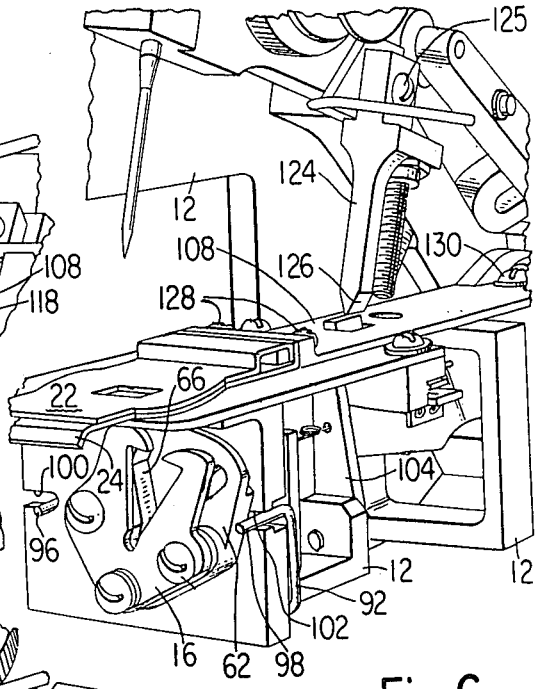
Fig. 6
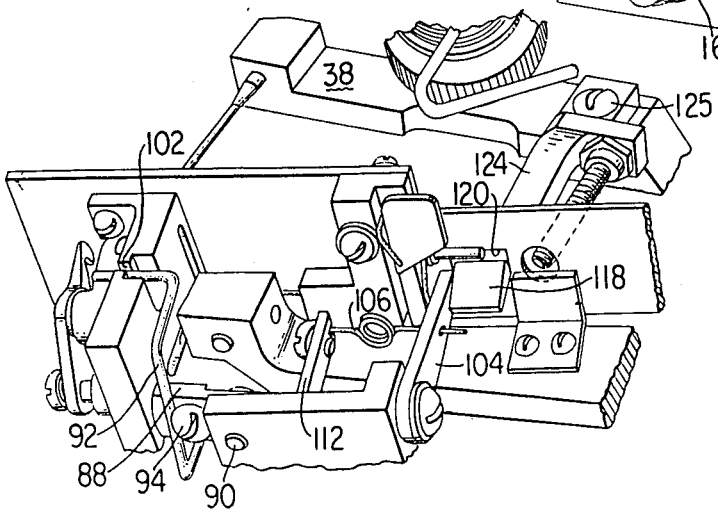
Fig. 7
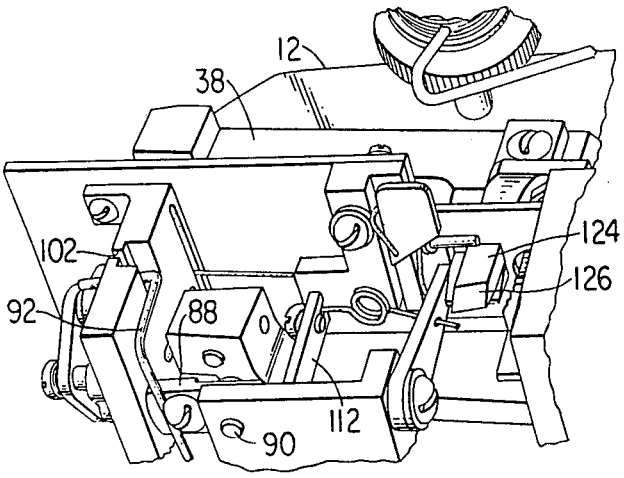
Fig. 8

WORK CLAMP SHIFTING MECHANISM FOR SEWING MACHINES

DESCRIPTION

BACKGROUND OF THE INVENTION

This invention relates to an operator influenced control for shifting the position of a sewing machine work holding clamp, and more particularly, to an arrangement for shifting the clamp of a button sewing machine when sewing four hole buttons, successively to orient different pairs of holes in the button for penetration by the sewing machine needle.

Industrial button sewing machines are known in which driven clamp shifting mechanism is employed. The present invention, however, is especially adapted for use with a hand operated household button sewing device and provides for manual operation of a device for shifting the stitching between pairs of holes in a button.

SUMMARY OF THE INVENTION

It is an object of this invention to provide an operator influenced work clamp shifting mechanism which is simple in construction so that it may be incorporated effectively on a hand operated household button sewing device. It is also an object of this invention to provide an arrangement for releasing the sewing machine thread tension during the interval while the work clamp is being shifted by the operator influenced mechanism so that tension in the sewing thread will not impede shift of the work along with the work clamp.

DESCRIPTION OF THE DRAWINGS

With the above and additional objects and advantages in view, as will hereinafter appear, this invention will now be described with reference to a preferred embodiment illustrated in the accompanying drawing in which:

FIGS. 5, 6, 7 and 8 are fragmentary perspective views of a sewing machine similar to that of FIG. 1 but taken from a copending U.S. patent application Ser. No. 461,825, filed Jan. 28, 1983 of K. H. Killinger which is incorporated by reference herein; which figures are incorporated herein to disclose the means for effecting stitch-by-stitch movement of the stitch forming instrumentalities and the work clamp in a direction relatively to each other for the formation of a tack of zigzag stitches.

DESCRIPTION OF THE INVENTION

Figure 1:
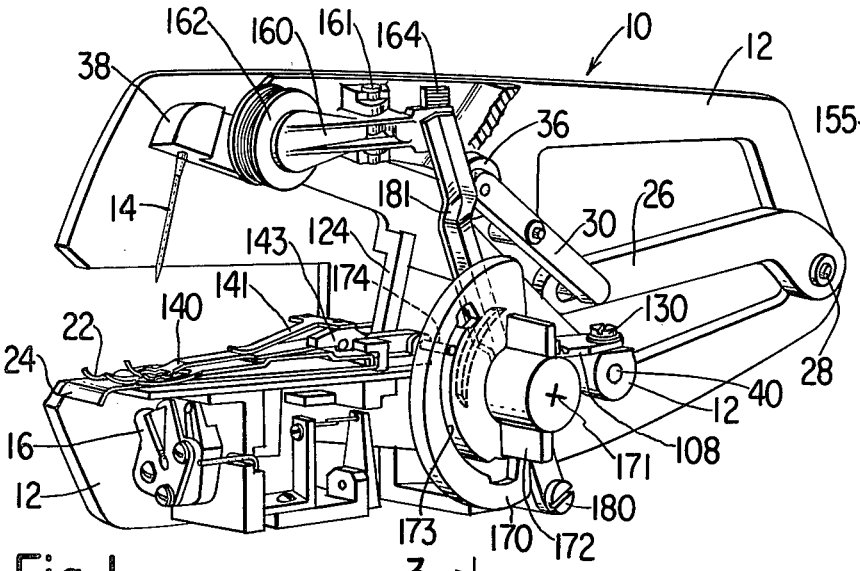
FIG. 1 is a perspective view of a sewing machine having this invention applied thereto.

This invention has particular utility as applied to a hand operated sewing machine of the type disclosed in the co-pending U.S. patent application Ser. No. 461,825, filed Jan. 28, 1983, of K. H. Killinger which is incorporated herein by reference. The sewing machine and the stitch forming mechanism thereof which are illustrated in FIG. 1, are basically the same as disclosed in the referenced Killinger patent application and for the common parts thereof which are illustrated herein the same reference characters are used as in the Killinger patent application. Referring particularly to FIG. 1 of the drawing, 10 indicates a hand held sewing machine to which the present invention may be applied. The sewing machine is assembled on an integral frame 12 and carries stitch forming instrumentalities including a needle 14 reciprocatable in cooperation with a looptaker 16 to concatenate thread carried by the needle into chain stitches.

Manipulation of an operating lever 26 fulcrummed at 28 on the frame 12 serves to impart cooperating movements to the needle 14 and looper 16. The operating lever 26 imparts reciprocatory movement to the needle 14 by way of an intermediate link 30 with a roller 36 which impinges upon and oscillates a needle carrying arm 38 fulcrummed on a pin 40 in the frame 12.

Operative connections (not shown) are provided between the needle carrying arm 38 and the looper 16 for operating the looper in timed relation with needle reciprocation in the formation of stitches.

A work clamp carrier 108 is pivotally supported on the frame 12 by a machine screw 130. Fabric clamping members 22 and 24 are secured for lateral oscillatory movement with the carrier 108. The carrier 108 is also formed with an aperture 120 through which a plunger 124 on the needle carrying arm 38 passes on each needle penetration.

Feeding mechanism in accordance with the invention is provided for reciprocating work under the needle 14. Such feeding mechanism includes a lever 88 which is pivotally mounted on a pin 90 in frame 12, and has a member 92 affixed thereon at 94. Member 92 includes fingers 96 and 98 that extend through slots 100 and 102 respectively, in block 60 to engage opposite sides of cam 62. The feeding mechanism further includes a feed pawl 104, a wire spring 106 which connects lever 88 with the feed pawl, and a clamp carrier 108. As shown, one end of spring 106 extends through a hole 110 in pawl 104 and the other end of the spring extends through a slot 114 in an upstanding end portion 112 of lever 88. The lower end of the pawl 104 is pivoted at 116 in the frame, and a wedge-shaped upper end portion 118 projects through an opening 120 in clamp carrier 108. The width of opening 120 is sufficient to accommodate the upper end portion 118 of pawl 104 as well as a depending plunger 124 which is affixed to arm 38 with a screw 125 and is movable into and out of the opening as the arm is caused to pivot on shaft 40. Plunger 124 has a lower wedge-shaped end portion 126 as shown.

While the needle carrying arm 38 is in a raised position, the looper affixed cam 62 is in an extreme pivoted position against finger 96 or 98, and lever 88 is disposed to cause spring 106 to hold end portion 118 of pawl 104 against one side or the other of opening 120 as determined by the position of the cam 62. When arm 38 is moved downwardly by the squeezing of lever 26, plunger 124 is caused to move into opening 120. As the plunger 124 moves into opening 120, wedge edge portion 126 pushes against feed pawl 104, whereupon the pawl is caused to move carrier 108 and clamping members 22 and 24 attached thereto by screws 128 about a pivotal mounting for the carrier at 130. Fabric positioned between the clamping member is thereby moved laterally under the needle and disposed for needle penetration before the needle can enter the fabric.

After the initial downstroke of arm 38 and upon the release of lever 26, arm 38 is moved upwardly to withdraw needle 14 from the fabric, and plunger 124 from opening 120. During such upward movement, looper affixed cam 62 is pivoted away from the then engaged finger on member 92, and into enforced engagement with the other finger. Lever 88 is moved to stress spring 106 in a manner causing pawl 104 to be biased against plunger 124, and when the plunger clears the pawl the stored energy in the spring is released whereupon the pawl is moved by spring action from the one side by opening 120 to the other.

During the next downstroke of arm 38 occasioned by the squeezing of lever 26, plunger 124 acts against upper portion 118 of pawl 104 on the side opposite from that engaged by the plunger during its initial downstroke. As a consequence the pawl is caused to move carrier 108 and attached clamping members 22 and 24 along with fabric therebetween in a direction opposite to the direction in which they were moved during the initial downstroke, and the fabric is so repositioned for needle penetration.

As the arm 38 is again moved upwardly upon the release of lever 26 to thereby withdraw needle 14 from fabric and plunger 124 from opening 120, looper affixed cam 62 is pivoted away from the engaged finger on member 92 and into enforced engagement with the other finger. Lever 88 is moved to stress the spring 106 while pawl 104 is still in engagement with plunger 124 and when the plunger clears the pawl the spring moves the pawl across opening 120 to its initial position to complete an operative cycle of the machine.

Figure 2:
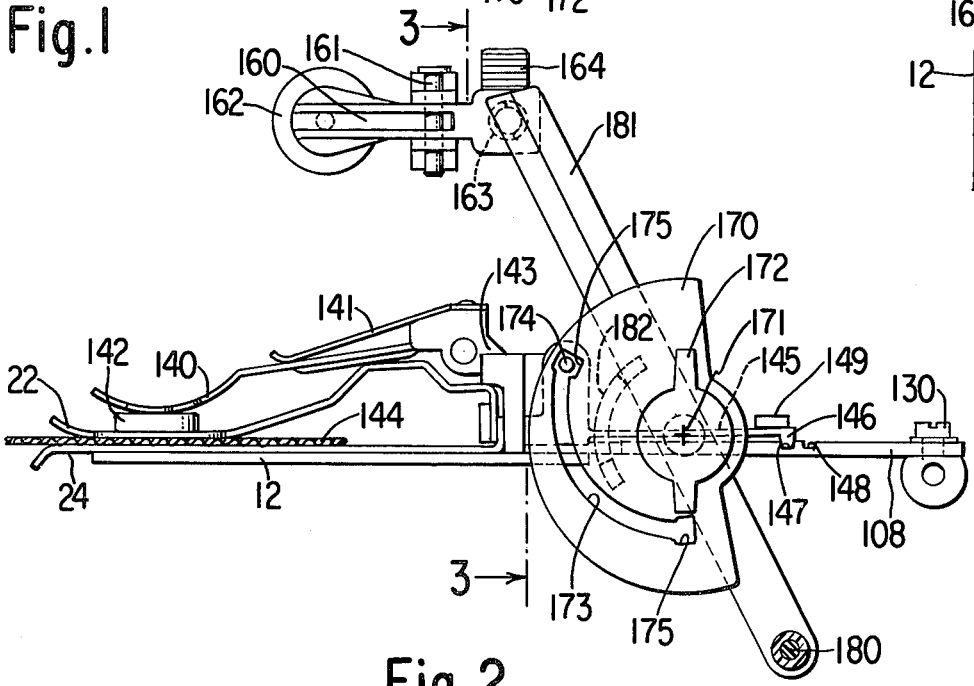
FIG. 2 is an enlarged side elevational view of the work holding clamp and the tension device of the sewing machine shown in FIG. 1 together with the mechanism comprising this invention.

In order to adapt the sewing machine disclosed in the referenced Killinger patent application to four hole button sewing, a number of modifications are required. A button engaging member 140 is arranged above the fabric clamping member 22 preferrably with a leaf spring 141 applying downward pressure thereto so as to press the button engaging member 140 against a button 142 when it is placed thereunder. It will be understood that the fabric 144 to which the button 142 is to be stitched should be placed between the fabric clamping elements 22 and 24 as shown in FIG. 2. The fabric clamping elements 22 and 24 together with the button member 140 collectively define work gripping jaws.

To accommodate lengthwise as well as pivotal movement to the work gripping jaws, the elements 22 and 24 together with the button engaging member 140 and the leaf spring 141 are all supported as a unitary assembly on a mounting block 143. The mounting block 143 is constrained as by any suitable interengaging guide arrangement with the carrier 108 for lengthwise sliding movement perpendicular to the direction of lateral stitch-by-stitch movement and the block 143 is formed with a rearwardly extending arm 145 formed with a downturned finger 146.

Another modification required to adapt the disclosure of the Killinger patent application to button sewing involves the thread tensioning device. As shown, a lever 160 is fulcrummed on a pin 161 carried in the machine frame and bears at one side of the fulcrum against a thread carrying bobbin 162 loosely journalled on the frame. A coil spring 163 bears against the lever 160 at the opposite side of the fulcrum from the bobbin to force the lever against the bobbin thus generating thread tension when thread is drawn from the bobbin. A finger grip 164 may be formed on the lever opposite the spring 163 so that an operator may depress the lever to remove tensioning force from the bobbin as when replacing bobbin or removing work from the machine. This thread tensioning arrangement also serves, as will be explained hereinbelow, to facilitate thread tension release during shift of the work when bringing a different pair of holes in a button into registry with the stitching point of the machine.

Figure 4:
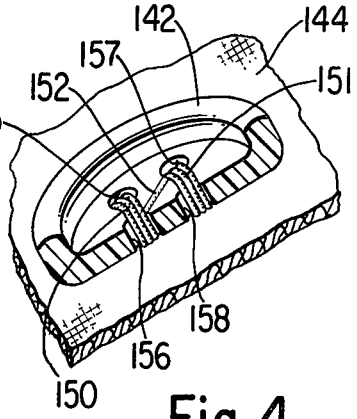
FIG. 4 is a perspective view of a four hole button with a portion broken away illustrating the securing stitches formed by the mechanism of this invention.

As illustrated in FIG. 4, the button 142 is formed with four holes 155, 156, 157 and 158 and requires two zig zag stitch tacks 150 and 151 for attachment to the fabric with a single crossing stitch 152 extending therebetween.

The sewing machine constructed as disclosed in the Killinger patent application would be capable of sewing only one of the zig zag stitch tacks 150 or 151 without requiring the work to be physically reoriented with respect to the work clamp.

The carrier 108 is formed with spaced notches 147, 148 for accommodating the finger 146 in either of two predetermined positions and thus providing detent means for locating the work gripping jaws in either of two different positions. A resilient constraining tab 149 on the carrier 108 biases the finger 146 toward the notches 147, 148.

In the present invention, an operator influenced work clamp shifting member 170 is provided, preferrably taking the form of a cam carrying disk and being pivotally supported for turning movement on an axis 171 in the frame 12 of the sewing machine and formed with a knob 172 for manipulation by an operator. The member 170 is formed with an arcuate cam slot 173 varying in distance from the axis 171. The cam slot 173 is tracked by a follower pin 174 projecting from the mounting block 143. As the member 170 is turned from one extreme position to the other, the follower pin in tracking the cam slot 173 will shift the mounting block lengthwise positioning selectively, either holes 155 and 156 or holes 157 and 158 of the button into registry with the path of reciprocation of the needle 14. The finger 146 of the detent means will enter and be constrained in one or the other of the notches 147 or 148 to lock the fabric and button clamping elements accurately into one or the other of the two lengthwise positions, in which positions the follower pin 174 will be disposed in one of the enlarged segments 175 at each extremity of the cam slot 173. It is the finger 146 and the notches 147 and 148 of the detent means which accurately determines the eventual lengthwise positions of the work fabric and button holding elements, not the cam slot 173. The enlarged segments 175 provide clearance to accommodate stitch-by-stitch lateral oscillation of the clamp.

Figure 3:
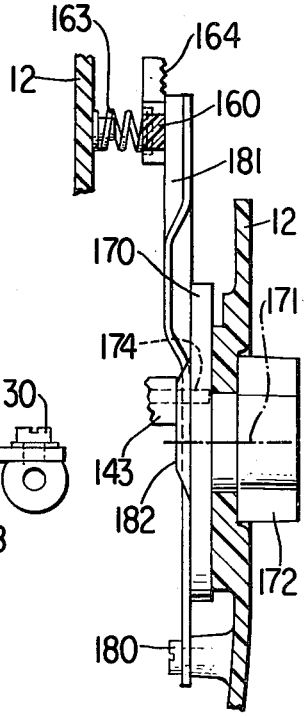
FIG. 3 is a cross sectional view taken substantially along line 3—3 of FIG. 2.

Loosely secured to the machine frame by a fastening screw 180 is a tension releasing bar 181 which is constrained as by any suitable means to occupy a position extending transversely across the work clamp shifting member 170. The bar 181 also traverses the tension lever 160 at the opposite side of the fulcrum pin 161 from the bobbin 162 and in opposition to the coil spring 163. The work clamp shifting member 170 is formed with an arcuate cam rib 182 projecting toward the tension releasing bar 181 as shown in FIG. 3. The rib 182 is positioned so as to engage and shift the bar 181 in opposition to the coil spring 163 during substantially the entire interval that the cam slot 173 is shifting the mounting block 143 to reposition the holes in a button between stitch tacks 150 and 151. The tension in the sewing thread will thus be released during such clamp shift thereby averting the possibility that tension in the thread might dislodge the button from the clamp or shift the fabric with respect to the clamp during such clamp movement. The rib is dimensioned and located so as to complete its traverse across the bar 181 before the conclusion of work clamp travel.

I claim:

1. A work clamp shifting mechanism for a sewing machine having a frame, stitch forming instrumentalities in said frame, a work clamp carrier pivotably supported on said frame, means for effecting stitch-by-stitch movement of said stitch forming instrumentalities and said work clamp carrier in a direction relatively to each other for the formation of a tack of zig zag stitches, and work gripping jaws shiftable supported on said work clamp carrier for movement perpendicular to the direction for said zig zag stitch tack forming relative movement, the improvement which comprises detent means engageable between said work gripping jaws and said work clamp carrier to establish predetermined relative positions of said work gripping jaws defining spaced tacks of zig zag stitches, operator influenced cam means carried on said machine frame, and cam follower means associated with said work gripping jaws and arranged to track said cam means for at-will effecting any selected re-arrangement of said detent means.

2. A work clamp shifting mechanism as set forth in claim 1 in which said cam follower comprises a pin extending from said work gripping jaws, in which said cam means comprised a curved cam slot formed in a shiftable cam member and accommodating said cam follower, and in which said cam slot is formed with enlarged segments providing for clearance between said cam follower pin and said cam slot in each engaged position of said detent means.

3. A work clamp shifting mechanism as set forth in claim 1 in which said sewing machine includes a thread tensioning device, a thread tension releasing mechanism, and means carried by said operator influenced cam means for operating said thread tension releasing mechanism during re-arrangement of said detent means by said operator influenced cam means.

4. A work clamp shifting mechanism as set forth in claim 3 in which said operator influenced cam means comprises a cam disk rotatably supported on said machine frame, in which said thread tension releasing mechanism includes a tension release bar extending transversely across said cam disk, and in which said means for operating said thread tension releasing mechanism comprises an arcuate cam rib extending from said cam disk toward said tension release bar, said arcuate cam rib being arranged to engage and operate said tension release bar during periods while said cam means is effecting re-arrangement of said detent means.

* * * * *